United States Patent [19]

Hausleithner

[11] 4,088,342

[45] May 9, 1978

[54] RELEASE BINDING FOR SKIS

[76] Inventor: Andreas Hausleithner, Prof. Penk. Str. 5, D-8102 Mittenwald, Germany

[21] Appl. No.: 753,682

[22] Filed: Dec. 23, 1976

[30] Foreign Application Priority Data

Dec. 24, 1975 Austria ..... 9843/75

[51] Int. Cl.[2] ..... A63C 11/12; A63C 9/081

[52] U.S. Cl. ..... 280/614; 280/618; 280/633

[58] Field of Search ..... 280/614, 618, 633, 630

[56] References Cited

U.S. PATENT DOCUMENTS

| | | | |
|---|---|---|---|
| 3,649,037 | 3/1972 | Vouthier | 280/628 |
| 3,877,712 | 4/1975 | Weckeiser | 280/614 |
| 3,930,661 | 1/1976 | Marker | 280/618 |
| 3,955,825 | 4/1976 | Kubelka et al. | 280/618 |

FOREIGN PATENT DOCUMENTS

| | | | |
|---|---|---|---|
| 2,231,402 | 12/1974 | France | 280/614 |
| 2,063,163 | 6/1972 | Germany | 280/614 |
| 78,270 | 3/1951 | Norway | 280/614 |

*Primary Examiner*—David M. Mitchell
*Attorney, Agent, or Firm*—McGlew and Tuttle

[57] ABSTRACT

A release binding for skis is usable both for touring or cross-country and downhill runs. It comprises a touring plate which has a front end portion which is pivotally mounted at its front end for movement about a horizontal axis which extends transverse to the longitudinal axis of the ski. The touring plate also includes a rear portion which is connected through a length adjustment mechanism to a heel holder portion. A sole holder is connected to the front end of the touring plate and it carries a blocking part which is seated on the touring plate and it includes an upstanding part adjacent its front end which is disposed above the horizontal pivotal axis of the touring plate which bears against a blocking element which is mounted on the ski ahead of the touring plate and is biased by a spring against the blocking part. When the touring plate is pivoted upwardly during a cross-country run, the blocking element is displaced rearwardly against the biasing force of the spring.

13 Claims, 13 Drawing Figures

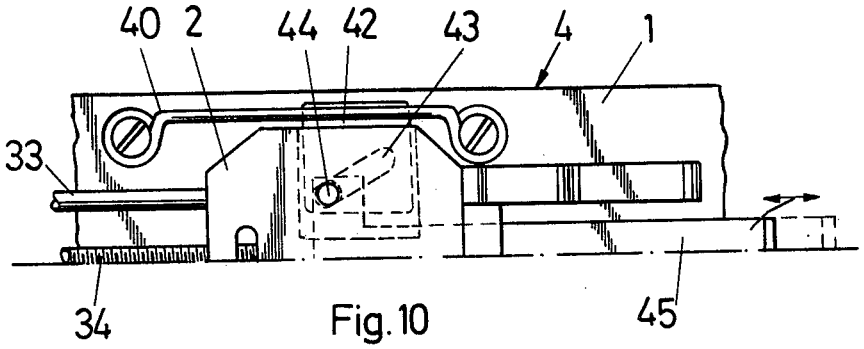
Fig. 10
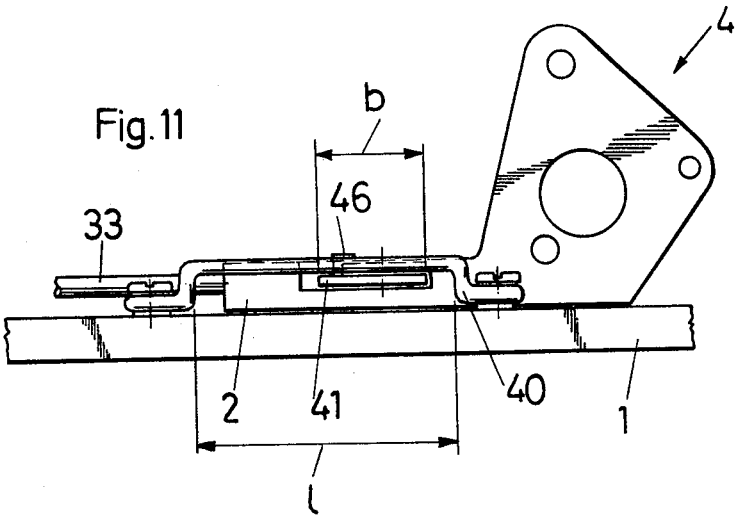
Fig. 11
Fig. 12
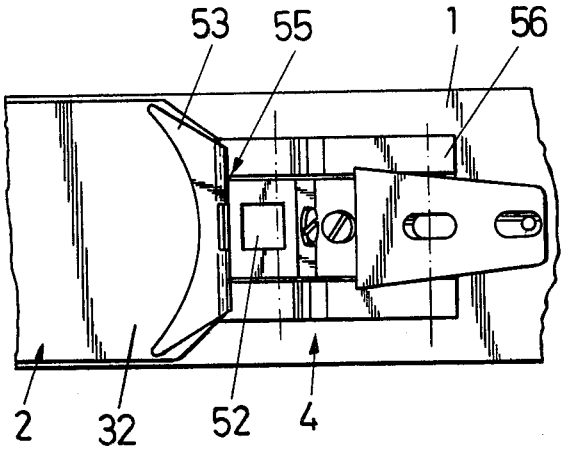

RELEASE BINDING FOR SKIS

FIELD AND BACKGROUND OF THE INVENTION

The present invention releates in general to release bindings for skis and, in particular, to a new and useful ski binding usable for both cross-country or touring and downhill runs, comprising a touring plate which is swingable, in its front zone, about an axis extending transversely to the longitudinal direction and parallel to the upper surface of the ski and which includes a rear end carrying the heel holder and connectable to the ski, and a front end carrying a sole holder which comprises a blocking part which is seated in the touring plate, the blocking part being associated with a blocking element which is movable against the action of a spring.

DESCRIPTION OF THE PRIOR ART

Ski bindings which are suitable for downhill runs as well as for touring are known and in most cases comprise a touring plate having a heel jaw mounted on the rear end of the plate. The front end of such touring plates is either hinged to the toe jaw or the toe jaw is mounted thereon and the touring plate is directly hinged to the ski. In consequence, while touring, the heel can be lifted from the ski. These bindings have the disadvantage, however, that kick-turns and side steps are difficult to perform, since due to the hinge, the skis swing freely in suspension from the boot tips, and snow can easily settle between the boot sole and the ski surface. This also works out badly while touring in steep grounds. The present invention is directed primarily to the elimination of the above-mentioned drawbacks, without complicating the construction thereof.

To readjust the binding from cross-country or touring to downhill runs, the known touring plates are mostly fixed at their rear ends by means of a locking bar which is engageable in the longitudinal direction of the ski below a retaining staple. This has the disadvantage that the transmission of tilting moments needed, for example, during edging, is insufficient.

Another problem with such ski bindings of the prior art is that rigid touring plates hinged at their front ends prevent a bending of the sole of the ski boot, which is essential for a natural walking motion.

On the other hand, if resilient touring plates are used, another disadvantage occurs in that due to the lifting of the heel from the ski, which is necessary for a walking motion, the boot is subject to a compressive bending stress, depending on the geometry of the binding, while the resilient plate is subject to a tensile bending stress. Thereafter, because of the small deformability of the ski boot, the lift of the heel from the ski is no longer sufficiently high and eventually, after a longer use, these properties result in a rupture or tearing-out of the touring plate and wearing down of the binding. In addition, the forced, unnatural movements of the foot are very tiresome for the skier.

Frequently, such ski bindings must also be adjustable to different boot sizes. To this end, in most instances, locking elements, such as gear teeth or the like, have been used, by means of which the distance between a toe jaw and a heel jaw can be adjusted. It has been found, however, that with a larger spacing of the notches, the binding cannot be adjusted exactly to the respective boot size. Such an exact adjustment, however, is just a condition for a perfect function of release bindings which, at present, are used almost exclusively, as well as a condition for the exact guidance of the ski. On the other hand, fine tooth gearing which would be necessary for narrowly spaced notches, makes the construction expensive and complicated, particularly if a large adjusting range is needed. In addition, fine gear teeth wear off very rapidly.

The present invention is therefore directed to the elimination of these problems and drawbacks occurring in the prior art touring bindings.

SUMMARY OF THE INVENTION

For this purpose, in accordance with the invention, there is provided a release binding for a ski, which comprises a touring plate, a heel holder, a sole holder with a blocking part, and a blocking element associated therewith, in which the blocking part is disposed above the swing axis of the touring plate and the blocking element is displaceable along a guideway fixed to the ski and is displaced by the blocking part against the action of a spring following a swinging motion either of the touring plate or of the sole holder. This offers the advantage that the blocking element cooperating with the blocking part exerts the force necessary for arresting the rotatable sole holder, and a force which is proportional to and opposed to the lifting motion of the touring plate.

It is preferable to provide the blocking part with a pivot by means of which it is seated in a bore of the touring plate, and to provide the pivot with a radial bore, which is perpendicular to the longitudinal direction of the ski and is enlarged in the plane of the touring plate, and through which the hinge pin of the touring plate extends.

Thus, the touring plate, as well as the blocking part with the sole holder, swing about a common axis embodied by the hinge pin which is fixed by its ends to the baseplate, and the pivoting of the blocking part is limited by the size of enlargement of the radial bore of the pivot, which enlargement preferably has a double-cone shape.

It is advantageous, particularly for an easy adjustment of the arresting force, if the blocking element is designed as a housing accommodating a spring which acts in the longitudinal direction of the ski and bears against a baseplate through an adjusting screw.

In a design which ensures that the tilting moments are transmitted particularly well, the touring plate is provided with at least one retractable and extensible locking element on each side which is engageable with a retaining staple extending in the longitudinal direction. Thereby, a transmission of bending moments from the ski to the touring plate is prevented. The locking elements may be designed as rotatable cam plates which are inexpensive in manufacture.

To obtain easy manipulation, it is advantageous to design the locking elements as small plates with oblique slots which extend symmetrically on both sides and into which studs are engaged which are provided on an actuating slide. This locking system is particularly advantageous in cases where the difference between the inside length of the retaining staples and the width of the locking elements is equal to the difference between the maximum and minimum length of the ski boots, and the binding is adjustable in length.

In another embodiment, the touring plate comprises at least two separate parts which are connected to each other, in the zone of the ball of the foot, by a hinge extending parallel to the axis of the front hinge, so that the touring plate can adapt to the movements of the ski boot.

In a preferred embodiment, the touring plate is connected, through a threaded rod, directly or indirectly, to the heel holder, and the threaded rod is engaged, at least unilaterally, in a counter-thread. This design simplifies the construction and, at the same time, makes it possible to obtain an optimum and continuous adjustment of the binding.

In a particularly advantageous embodiment of the invention, the heel holder is preferably shiftable on guide rods and is connected, directly or indirectly, through at least one threaded rod, to the front part of the ski binding. Advantageously, the threaded rod is non-rotatably connected to an actuating member which can be blocked by a securing member. Preferably, the securing member and the actuating member which, for example, may have a cross-section of a winged nut, are positively connectable to each other so that a secure, wear-free blocking is obtained.

In a preferred variant, the adjusting mechanism of the touring plate is mounted between the respective parts. It is also advantageous to design the heel holder integral with the touring plate. In another embodiment, the counter-thread into which the threaded rod is screwed is provided in an element which is mounted for rotation in the respective part of the ski binding, so that the threaded rod can be fixed to the other part of the binding.

Accordingly, it is an object of the invention to provide a release binding for a ski which is usable for both touring (cross-country) and downhill runs, which includes a touring plate having a front end which forms a blocking part of a sole holder and which includes a rear portion pivotally connected to a front portion thereof and connected at its rear to a sole holder, which may be clamped in position over the ski for downhill run use or which may be loosened for cross-country use and wherein the blocking part of the sole holder includes an upstanding part which is disposed above the horizontal pivotal axis of the touring plate front portion and bears against a blocking element which is adapted to be mounted on the skis ahead of the blocking plate and which includes a spring biasing the blocking element into engagement with the blocking part, the blocking element being displaceable against the spring-biasing force upon a swinging motion of both the touring plate and the sole holder.

A further object of the invention is to provide a release binding for a ski which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings:

FIG. 10 is a side elevational view of a variant of the locking mechanism of the touring plate;

FIG. 11 is a side elevational view of the embodiment of FIG. 10; and

FIG. 12 is a top plan view of the embodiment of FIG. 10.

DESCRIPTION OF THE PREFERRED EMBODIMENTS

Figure 1:
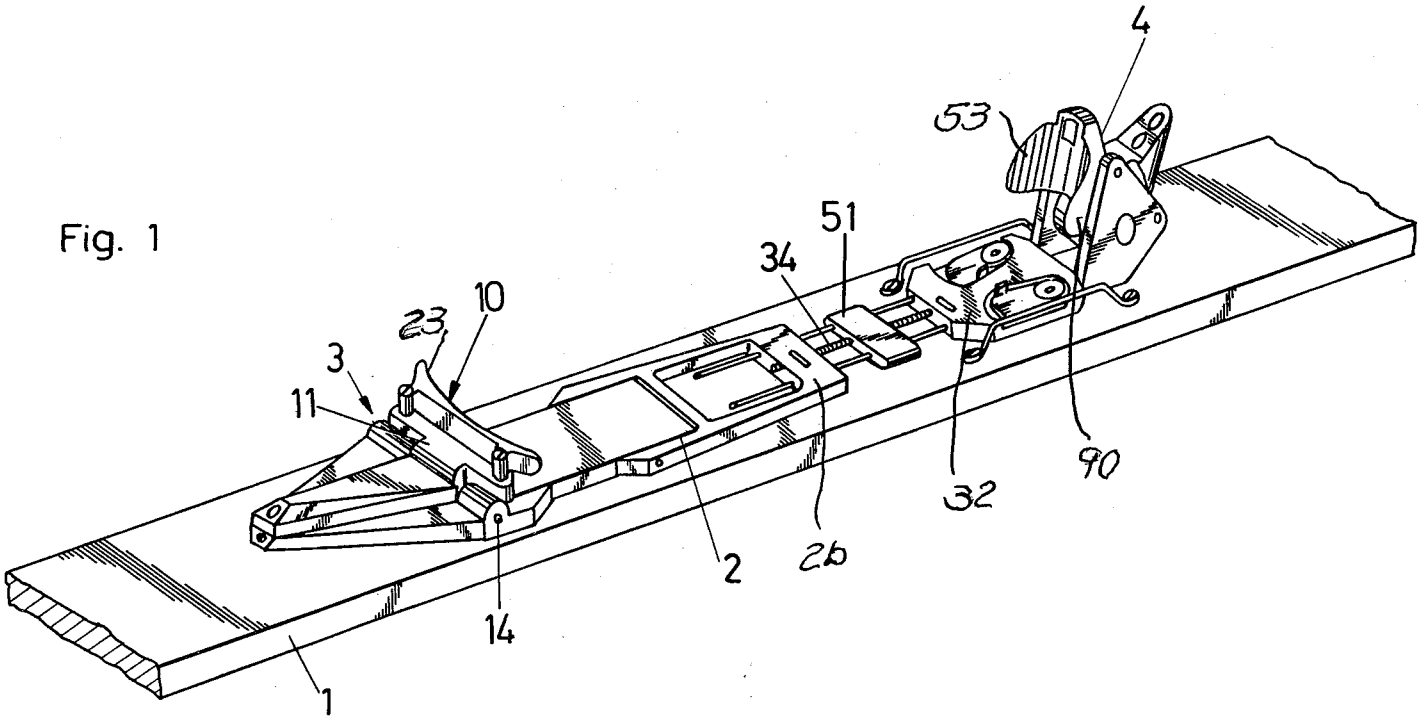
FIG. 1 is a front top perspective view of a ski binding constructed in accordance with the invention.

Referring to the drawings in particular, the invention embodied therein comprises a ski binding for use with a ski 1 which includes a toe jaw, generally designated 3, which is connected through a touring plate 2, to a heel jaw, generally designated 4, which may be held downwardly on the surface of the ski or permit it to pivot upwardly with a rear portion of the touring plate.

Figure 2:
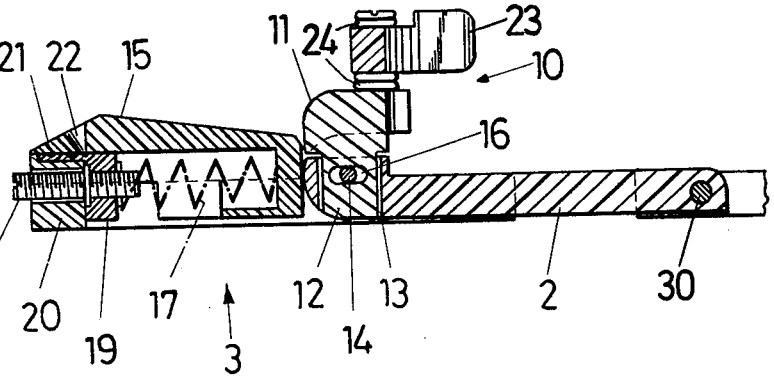
FIG. 2 is a longitudinal sectional view of the sole holder of FIG. 1 in a normal position.

Toe jaw 3 includes a retaining clamp 23 (see FIGS. 2 to 5) which is of unsymmetrical design with respect to its plane of support and is screwed, with the interposition of spacers 24, to a blocking part 11, thus forming the sole holder, generally designated 10. Clamp 23 can be turned upside down for adjustment to particularly thin ski boot soles. Blocking part 11 comprises a pivot 12 which is seated in a bore 13 of touring plate 2. Pivot 12 and touring plate 2 are provided with connecting bores 16 which extend transversely in the plane of the touring plate. A hinge pin 14 embodying the axis of rotation of touring plate 2 extends through bore 16. A blocking element housing part 15, as shown in FIG. 2, is pushed against blocking part 11 by a spring 17 which bears, through an intermediate part 19, against an adjusting screw 18 provided in a baseplate 20. The bias of spring 17 can be varied by turning screw 18 and the adjustment can be read on the intermediate part 19 which is provided with color points 21 and is visible through a sight opening 22 in housing 15.

Figure 3:
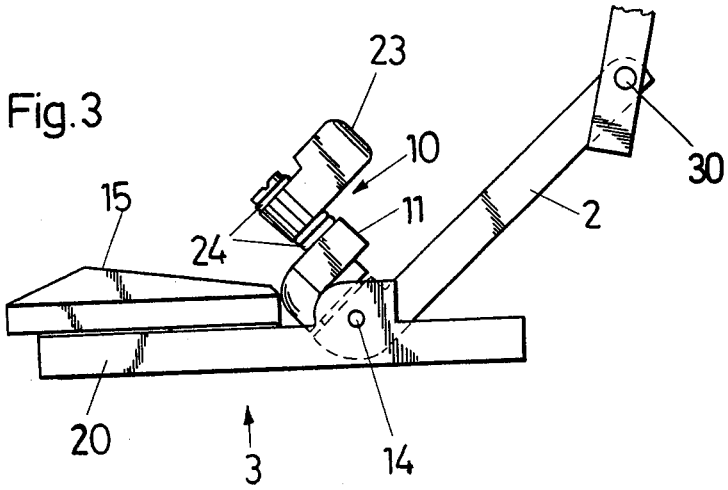
FIG. 3 is a side elevational view of the sole holder in a position during touring motion.
Figure 5:
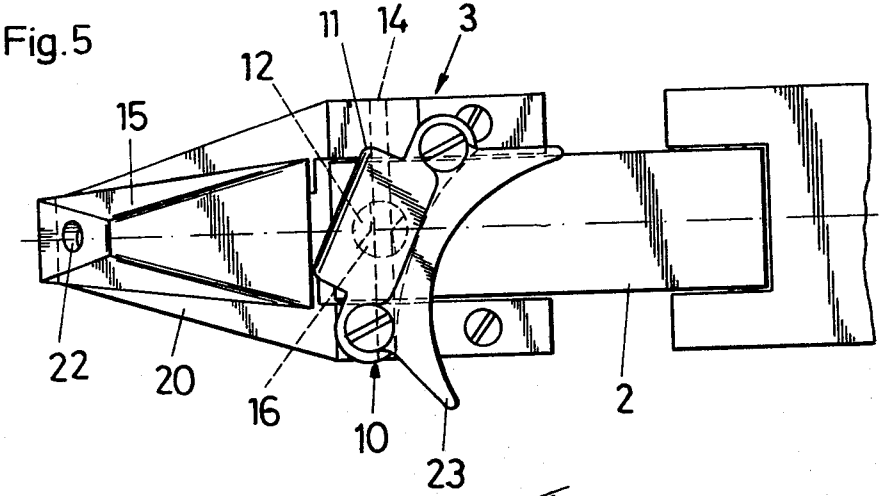
FIG. 5 is a view, similar to FIG. 4, showing the sole holder in release position, upon a torsional fall.

As shown in FIG. 3, if touring plate 2 is then lifted from the ski during motion, blocking part 11 displaces housing 15 forwardly. This produces an opposite force between touring plate 2 and the ski, which is proportional to the lifting of touring plate 2. The arresting force needed for retaining sole holder 10 in its central position is also produced by the housing part 15. This force may be increased or adjusted by biasing spring 17, as mentioned above. As soon as, upon a torsional fall, the arresting force is exceeded, sole holder 10, through blocking part 11, displaces housing 15 forwardly (FIG. 5).

Touring plate 2 (FIG. 6) comprises a front part 2*a* and a rear part 2*b*, which parts are connected to each other by a hinge pin 30 provided in the zone of the ball of the foot. Otherwise, part 2*a* is again hinged at 14 and carries the sole holder 10.

Figure 7:
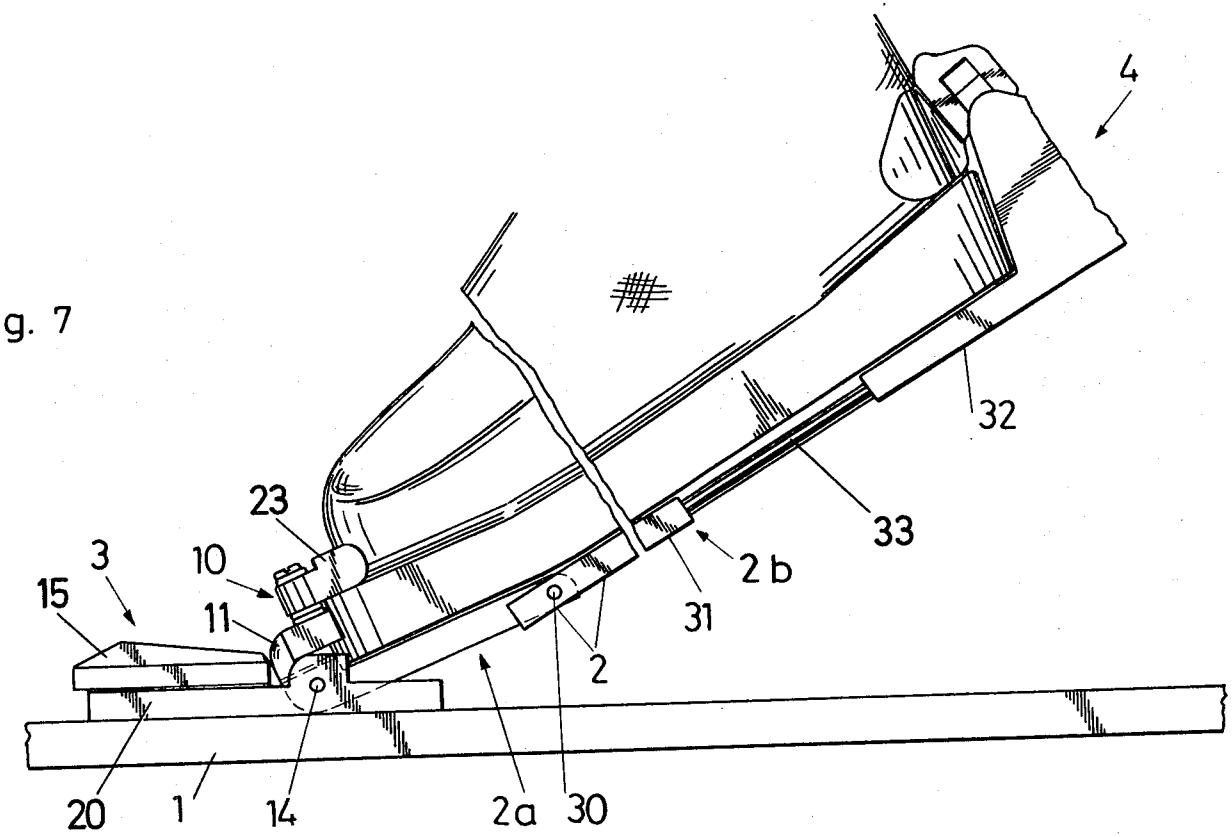
FIG. 7 is a view, similar to FIG. 6, showing the touring plate during touring motion, with the sole of the ski boot only slightly bent.

As may be learned from FIG. 7, the touring plate 2 thus jointed permits the ski boot sole to bend during motion.

Figure 8:
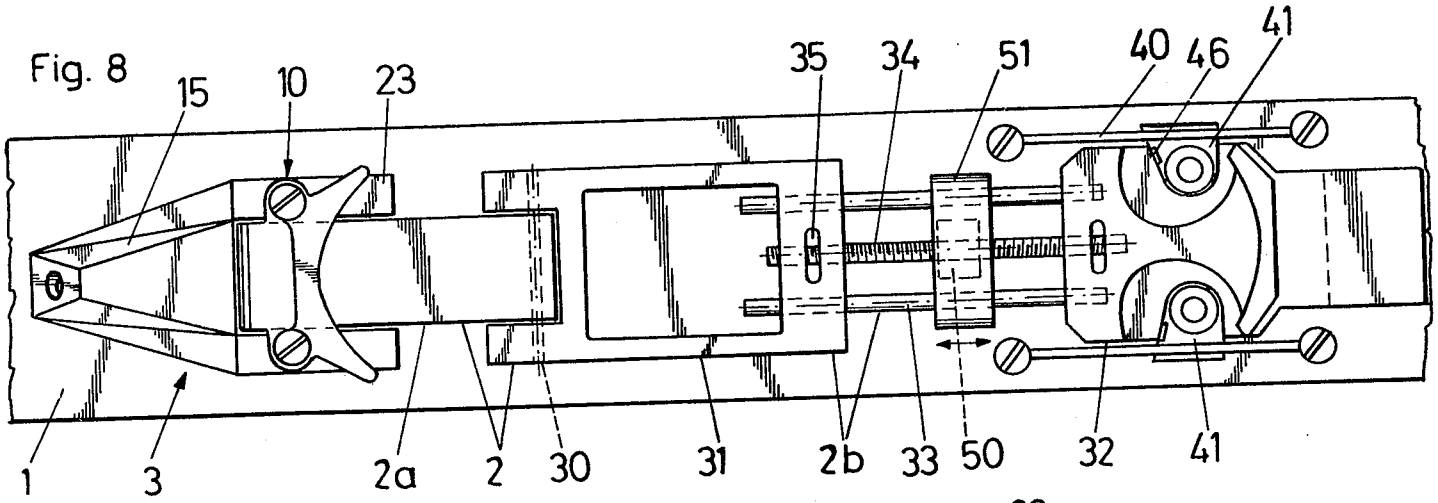
FIG. 8 is a top plan view of the release binding, with the touring plate and the mechanism for longitudinal adjustment locked.

Rear part 2*b* of touring plate 2 is provided with an adjusting mechanism and comprises two headpieces 31 and 32 (see FIG. 8). Headpiece 32 is integral with heel jaw 4. The two headpieces are connected to each other by guide rods 33, 33 which are rigidly secured to headpiece 32 at the side of heel jaw 4, and slide-fitted in headpiece 31. Between guide rods 33, a threaded rod 34 is provided having a lefthand and a righthand thread on respective opposite ends and it engages associated nuts 35 in the headpieces. In the middle portion of threaded rod 34, between the lefthand and the righthand threads, an actuating member 50 is non-rotatably connected to the rod, which member is designed with a winged-nut cross-section. The spacing between toe jaw and heel jaw can be varied by turning threaded rod 34 and, thereby, adapted to the size of the ski boot.

Figure 4:
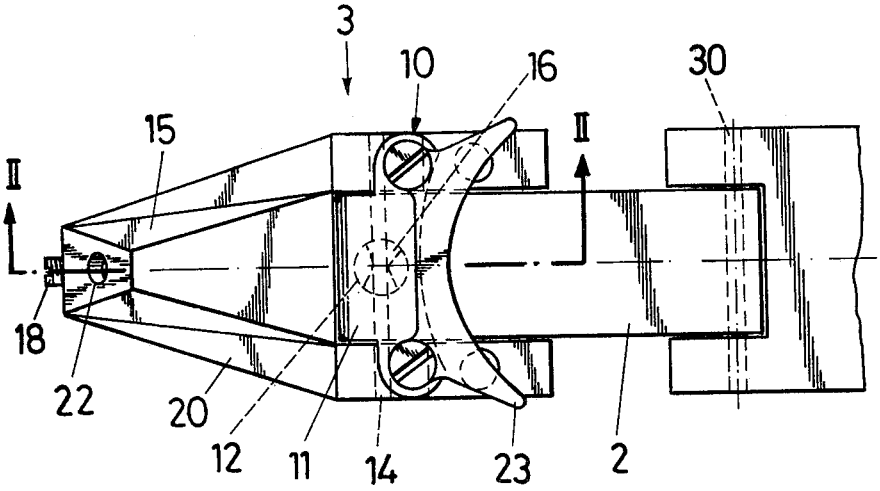
FIG. 4 is a top plan view of the sole holder.
Figure 6:
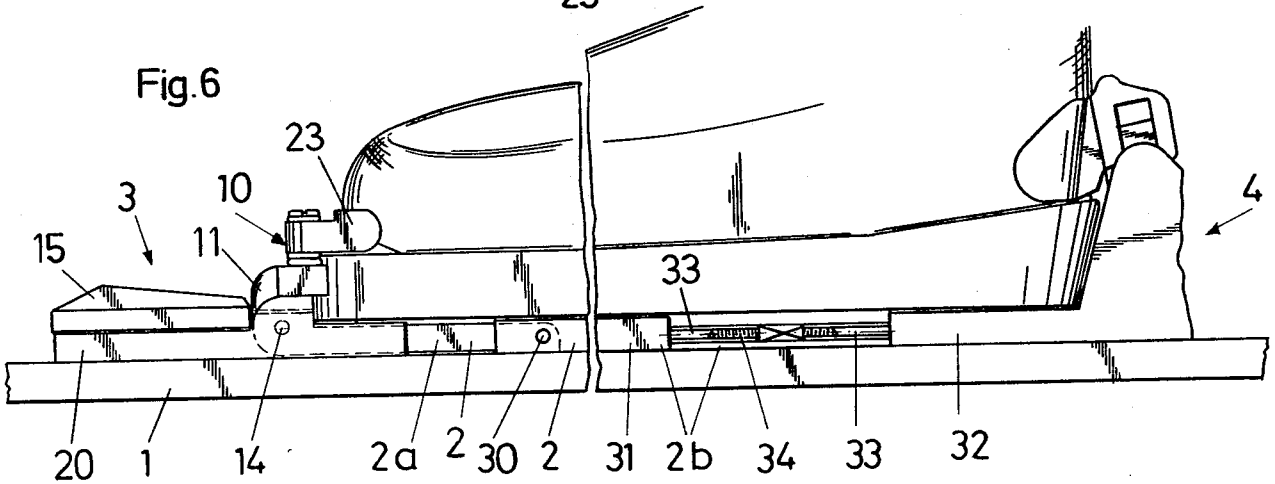
FIG. 6 is a side elevational view of the release binding, with the central part omitted, in basic position.

With this type of touring binding, in order to adapt the binding to a downhill run, it is advantageous to connect the touring plate 2 to headpiece 32 which is associated with the heel jaw, as shown in FIGS. 4 to 6. This connection is effected by means of two locking elements 41, 41 which are extensible laterally from headpiece 32 and engageable below retaining staples 40 which extend in the longitudinal direction of the ski on each side of the headpiece 32 and are secured to the ski 1. In the variant shown in FIG. 10, which shows one side of the symmetrically arranged locking mechanism, small, inserted plates 42 are provided which have oblique slots 43. In slots 43, studs 44 of an actuating slide 45 are engaged, so that upon moving actuating slide 45 in the longitudinal direction of the ski, plates 42 are retracted or extended.

FIG. 8 shows a variation with rotatable cam plates 41, 41 which are received in upwardly open recesses of headpiece 32. The cam plates 41, 41 are provided with actuating lugs 46 to permit turning of the plates into or out of engagement with the retaining staples 40 provided adjacent headpiece 32. The length of retaining staples 40 exceeds the width of the locking elements. The difference between the inside length *l* (FIG. 11) of retaining staple 40 and the width *b* of the locking elements is equal at least to the difference between the maximum and minimum length of ski boots to which the binding is adjustable.

Figure 9A:
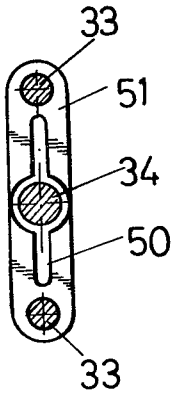
FIG. 9*a* is a section taken along the line 9A—9A of FIG. 9.
Figure 9:
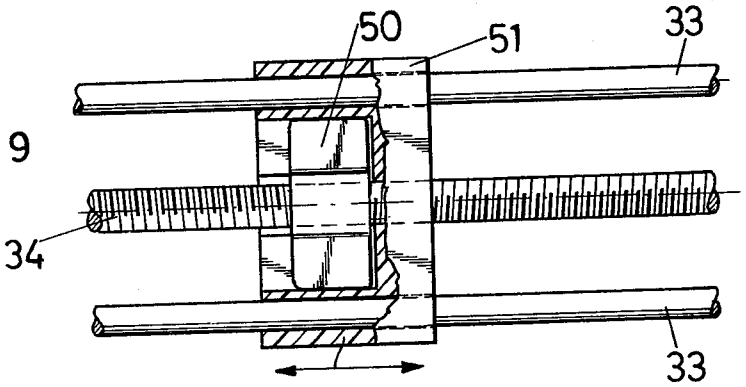
FIG. 9 is an enlarged detail of a portion of FIG. 8.

Since the touring binding comprises a touring plate with a hinge, a strong, pulsating force is exerted on the threaded rod 34 during the touring motion, which force may result little by little in a change of the adjusted length. To avoid this, a securing member 51 is mounted for displacement on guide rods 33, as shown in detail in FIG. 9. Securing member 51 is designed with a recess providing clearance for the actuating member 50, so that upon adjusting the desired length, member 51 can be shifted over the actuating member, thereby preventing an unintentional rotation of the threaded rod 34 which may be caused by the strong pulsating forces.

As shown in FIG. 12, heel jaw 4 is designed integral with headpiece 32 of touring plate 2. At the same time, a heel holder 50 is guided between two lateral walls forming a casing 56, which heel holder comprises a sole holder 53 and a spring box 52 with a tread nose 90 (FIG. 1).

While specific embodiments of the invention have been shown and described in detail to illustrate the application of the principles of the invention, it will be understood that the invention may be embodied otherwise without departing from such principles.

What is claimed is:

1. A release binding for a ski usable both for cross-country and downhill runs, comprising a front touring plate portion having a front end and an opposite rear end, a rear touring plate portion connected about a substantially horizontal first axis to said front touring plate portion for pivotal movement, mounting means on said ski for pivotally connecting said front touring plate portion adjacent its front end to the ski for pivotal movement about a substantially horizontal second axis, said touring plate rear portion having a rear end opposite to its connection to said touring plate front portion, a heel holder having a front end connected to said touring plate rear portion rear end, locking means for connecting said heel holder to the ski for downhill runs, a sole holder connected to the front end of said touring plate front portion for pivotal movement about a substantially vertical third axis relative to said touring plate, said sole holder having a blocking part seated on said touring plate front portion, said blocking part having an upstanding portion disposed above the horizontal pivotal second axis of said touring plate front portion, a blocking element disposed on the ski in front of said blocking part, blocking element mounting means for mounting said blocking element on said ski adapted to be fixed on said ski in front of said blocking part, spring means located on the blocking element mounting means biasing said blocking element against said blocking part, said blocking element being movable against the action of said spring means upon an upwardly swinging motion of both said touring plate front portion about said second axis and said sole holder and said blocking part about said substantially vertical third axis.

2. A release binding for a ski, according to claim 1, wherein said touring plate front part includes a transverse bore, a horizontally extending pivot pint disposed in said bore and comprising said horizontal second axis of said touring plate, a radial bore extending perpendicular to said transverse bore defined in said touring plate front portion, and a pivot in said radial bore for pivotally supporting said sole holder and blocking part for movement about said vertical third axis.

3. A release binding for a ski, according to claim 1, wherein said blocking element comprises a housing member, said blocking element mounting means comprises a base plate adapted to be mounted on the ski, said housing member including a portion overlying said base plate, a spring disposed within said housing, said housing being guided on said base plate for longitudinal movement toward and away from said blocking part, and an adjusting screw carried on said base plate and having an end containing one end of said spring and being insertable in said base plate to adjust the tension on said spring.

4. A release binding for a ski, according to claim 1, said locking means including fixed retaining staples adapted to be secured to a ski adjacent said heel holder, and retractable and extensible locking elements carried on said heel holder for locking said heel holder to the ski or releasing the heel holder from the ski.

5. A release binding for a ski, according to claim 4, wherein said retractable and extensible locking elements comprise rotatable plates carried on said heel holder.

6. A release binding for a ski, according to claim 4, wherein said retractable and extensible locking elements comprise plates carried by said heel holder, each of said plates having anobliquely extending slot therein, an actuating slide displaceable on said heel holder and having studs engaged with the slots of said plates to move said plates laterally during longitudinal movement of said slide, said plates being movable between a position in which they engage in said retaining staples and one in which they release from said retaining staples.

7. A release binding for a ski usable both for cross-country and downhill runs, comprising a touring plate having a front end and an opposite rear end, mounting means on said ski for pivotally connecting said touring plate adjacent its front end to the ski for pivotal movement about a substantially horizontal axis, a heel holder having a front end connected to said touring plate rear end, locking means on said ski for connecting said heel holder to the ski for downhill runs, a sole holder connected to the front end of said touring plate, said sole holder having a blocking part seated on said touring plate, said blocking part having an upstanding portion disposed above the horizontal pivotal axis of said touring plate, a blocking element disposed on the ski in front of said blocking part, blocking element mounting means for mounting said blocking element on the ski and adapted for slidable movement of said blocking element, spring means located on the blocking element mounting means biasing said blocking element against said blocking part, said blocking element being movable against the action of said spring means upon a swinging motion of both said touring plate upwardly.

8. A release binding for a ski, according to claim 7, including adjustment means for longitudinal adjusting the touring plate connected between said touring plate and said heel holder.

9. A release binding for a ski, according to claim 8, wherein said adjustment means includes a threaded rod extending between said touring plate and said heel holder and having at least one end in threaded engagement with at least one of said heel holder and said touring plate and the opposite end being freely movable in respect to the other of these parts.

10. A release binding for a ski, according to claim 9, including guide rods between said touring plate and said heel holder for guiding said heel holder relative to said touring plate.

11. A release binding for a ski, according to claim 7, including a rod member connected between said touring plate and said heel holder, one end being in threaded engagement and the opposite end being freely movable in respect to respective ones of said heel holder and said touring plate and an actuating member non-rotatably connected to said threaded rod for rotating said rod and a securing member means mounted between said touring plate and said heel holder for pivotal movement with said plate and translational movement in the plane of said plate for selective movement to a position which covers and blocks said actuating member.

12. A release binding for a ski, according to claim 11, wherein said actuating member comprises a wing nut, said securing member means selectively covering said wing nut.

13. A release binding for a ski, according to claim 12, including guide rod means disposed between said touring plate and said heel holder for guiding these parts relative to each other, said securing member being displaceable along said guide rod means.

* * * * *